US010467848B2

(12) United States Patent
Chun

(10) Patent No.: US 10,467,848 B2
(45) **Date of Patent: *Nov. 5, 2019**

(54) SYSTEM FOR MONITORING AND PLAYING A PLURALITY OF LIVE CASINO TABLE GAMES

(71) Applicant: IGT, Las Vegas, NV (US)

(72) Inventor: Jay Chun, Hong Kong (CN)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/946,372

(22) Filed: Apr. 5, 2018

(65) Prior Publication Data

US 2018/0225917 A1 Aug. 9, 2018

Related U.S. Application Data

(63) Continuation of application No. 13/685,226, filed on Nov. 26, 2012, now Pat. No. 9,940,778, which is a (Continued)

(51) Int. Cl.

| | |
|---|---|
| ***G07F 17/32*** | (2006.01) |
| ***A63F 1/00*** | (2006.01) |
| ***A63F 3/00*** | (2006.01) |

(52) U.S. Cl.

CPC ..... *G07F 17/3225* (2013.01); *A63F 1/00* (2013.01); *A63F 3/00157* (2013.01);

(Continued)

(58) Field of Classification Search

CPC ..... A63F 1/00; A63F 2001/001; A63F 2001/008; A63F 3/00157; G07F 17/3288

(Continued)

(56) References Cited

U.S. PATENT DOCUMENTS

| | | | |
|---|---|---|---|
| 3,708,219 | A | 1/1973 | Forlini et al. |
| 3,810,627 | A | 5/1974 | Levy |

(Continued)

FOREIGN PATENT DOCUMENTS

| | | |
|---|---|---|
| CA | 2377577 | 6/2000 |
| EP | 0478412 | 4/1992 |

(Continued)

OTHER PUBLICATIONS

International Search Report for PCT/CA2006/002069, dated Mar. 20, 2007, 16 pgs.

(Continued)

*Primary Examiner* — William H McCulloch, Jr.
(74) *Attorney, Agent, or Firm* — Neal, Gerber & Eisenberg LLP

(57) ABSTRACT

A system for monitoring and playing a plurality of live casino table games, comprising: a plurality of dealer game tables; a plurality of electronic handheld devices remotely located from the game tables configured to display a video of at least one game taking place at the plurality of game tables; a gaming server; and a network operatively coupling the gaming server to the game tables and the electronic handheld devices; wherein each electronic handheld device includes a display part comprising: a player wagering display area having a touch screen input configured to display a plurality of touch screen results bars that allow a player to switch between the plurality of the game table's videos in response to touching the touch screen results bar to provide a selected touch screen results bar; a video display area configured to display a video of at least one game taking place at the plurality of game tables, wherein the video being displayed corresponds to the selected touch screen results bar.

20 Claims, 9 Drawing Sheets

Related U.S. Application Data continuation-in-part of application No. 13/042,633, filed on Mar. 8, 2011, now Pat. No. 9,940,777, which is a continuation of application No. 11/497,708, filed on Aug. 1, 2006, now Pat. No. 7,922,587, which is a continuation-in-part of application No. 11/042,732, filed on Jan. 24, 2005, now Pat. No. 7,918,723, and a continuation-in-part of application No. 11/198,218, filed on Aug. 5, 2005, now abandoned, and a continuation-in-part of application No. 11/312,150, filed on Dec. 19, 2005, now Pat. No. 7,914,368.

(52) U.S. Cl.
CPC ..... *G07F 17/322* (2013.01); *G07F 17/3223* (2013.01); *G07F 17/3288* (2013.01); *A63F 2001/001* (2013.01); *A63F 2001/008* (2013.01)

(58) Field of Classification Search
USPC ..... 463/10–13, 26–28, 42; 273/149 R, 292
See application file for complete search history.

(56) References Cited

U.S. PATENT DOCUMENTS 3,909,002 A 9/1975 Levy
3,998,309 A 12/1976 Mandas et al.
4,095,795 A 6/1978 Saxton
4,333,715 A 6/1982 Brooks
4,337,945 A 7/1982 Levy
4,339,798 A 7/1982 Hedges
4,448,419 A 5/1984 Telnaes
4,467,424 A 8/1984 Hedges
4,517,558 A 5/1985 Davids
4,607,844 A 8/1986 Fullerton
4,621,814 A 11/1986 Stepan et al.
4,659,082 A 4/1987 Greenberg
4,659,182 A 4/1987 Aizawa
4,662,635 A 5/1987 Enokian
4,718,672 A 1/1988 Okada
4,805,907 A 2/1989 Hagiwara
4,856,787 A 8/1989 Itkis
4,858,932 A 8/1989 Keane
4,861,041 A 8/1989 Jones
4,911,449 A 3/1990 Dickinson et al.
4,912,548 A 3/1990 Shanker et al.
4,926,327 A 5/1990 Sidley
4,998,737 A 3/1991 Lamle
5,033,744 A 7/1991 Bridgeman
5,042,818 A 8/1991 Weingardt
5,048,833 A 9/1991 Lamle
5,084,833 A 1/1992 Matsuda et al.
5,086,354 A 2/1992 Bass et al.
5,113,272 A 5/1992 Reamey
5,132,839 A 7/1992 Travis
5,248,142 A 9/1993 Breeding
5,265,882 A 11/1993 Malek
5,288,081 A 2/1994 Breeding
5,319,491 A 6/1994 Selbrede
5,325,830 A 7/1994 Hammer
5,342,047 A 8/1994 Heidel et al.
5,362,064 A 11/1994 Lofink
5,364,100 A 11/1994 Ludlow et al.
5,376,587 A 12/1994 Buchmann et al.
5,393,061 A 2/1995 Manship et al.
5,393,067 A 2/1995 Paulsen
5,395,119 A 3/1995 Jacob
5,395,120 A 3/1995 Malek
5,397,133 A 3/1995 Penzias
5,413,351 A 5/1995 Franklin
5,456,465 A 10/1995 Durham
5,467,893 A 11/1995 Landis et al.
5,472,194 A 12/1995 Breeding et al.
5,476,259 A 12/1995 Weingardt
5,490,670 A 2/1996 Hobert
5,494,296 A 2/1996 Grassa
5,539,547 A 7/1996 Ishii et al.
5,544,892 A 8/1996 Breeding
5,564,700 A 10/1996 Celona
5,580,055 A 12/1996 Hagiwara
5,580,310 A 12/1996 Orus et al.
5,585,821 A 12/1996 Ishikura et al.
5,586,937 A 12/1996 Menashe
5,588,650 A 12/1996 Eman et al.
5,589,980 A 12/1996 Bass et al.
5,605,334 A 2/1997 McCrea, Jr.
5,611,730 A 3/1997 Weiss
5,613,909 A 3/1997 Stelovsky
5,618,232 A 4/1997 Martin
5,639,092 A 6/1997 MacAisa
5,642,698 A 7/1997 Diehl et al.
5,643,086 A 7/1997 Alcorn et al.
5,655,961 A 8/1997 Acres et al.
5,664,998 A 9/1997 Seelig
5,668,174 A 9/1997 Kawagishi
5,669,606 A 9/1997 Brown
5,673,917 A 10/1997 Vancura
5,707,287 A 1/1998 McCrea, Jr.
5,722,890 A 3/1998 Libby et al.
5,735,525 A 4/1998 McCrea, Jr.
5,743,523 A 4/1998 Kelly et al.
5,743,798 A 4/1998 Adams et al.
5,745,197 A 4/1998 Leung et al.
5,752,881 A 5/1998 Inoue
5,752,882 A 5/1998 Acres et al.
5,759,103 A 6/1998 Freels et al.
5,762,552 A 6/1998 Vuong et al.
5,764,317 A 6/1998 Sadovnik et al.
5,766,076 A 6/1998 Pease et al.
5,770,533 A 6/1998 Franchi
5,772,509 A 6/1998 Weiss
RE35,864 E 7/1998 Weingardt
5,775,993 A 7/1998 Fentz
5,779,546 A 7/1998 Meissner
5,782,692 A 7/1998 Stelovsky
5,788,574 A 8/1998 Ornstein
5,791,992 A 8/1998 Crump et al.
5,795,225 A 8/1998 Jones
5,797,795 A 8/1998 Takemoto et al.
5,800,268 A 9/1998 Molnick
5,803,451 A 9/1998 Kelly et al.
5,806,854 A 9/1998 Coleman
5,820,459 A 10/1998 Acres et al.
5,820,461 A 10/1998 Pernatozzi
5,830,067 A 11/1998 Graves
5,836,817 A 11/1998 Acres et al.
5,836,818 A 11/1998 Jones
5,839,730 A 11/1998 Pike
5,839,731 A 11/1998 Feola
5,842,698 A 12/1998 Brown
5,851,149 A 12/1998 Xidos et al.
5,873,781 A 2/1999 Keane
5,876,283 A 3/1999 Parra
5,879,006 A 3/1999 Bowling
5,879,235 A 3/1999 Kaneko
5,885,085 A 3/1999 Fujita
5,888,136 A 3/1999 Herbert
5,909,876 A 6/1999 Brown
5,910,046 A 6/1999 Wada et al.
5,911,626 A 6/1999 McCrea, Jr.
5,921,865 A 7/1999 Scagnelli
5,931,471 A 8/1999 Bonito
5,951,397 A 9/1999 Dickinson
5,956,180 A 9/1999 Bass et al.
5,957,459 A 9/1999 Chae
5,961,119 A 10/1999 Brown
5,967,893 A 10/1999 Lawrence et al.
6,001,016 A 12/1999 Walker
6,015,346 A 1/2000 Bennett
6,019,374 A 2/2000 Breeding
6,027,115 A 2/2000 Griswold et al.
6,039,650 A 3/2000 Hill
6,050,895 A 4/2000 Luciano et al.
6,054,969 A 4/2000 Haisma

(56) References Cited

U.S. PATENT DOCUMENTS 6,056,641 A 5/2000 Webb
6,059,658 A 5/2000 Mangano et al.
6,080,063 A 6/2000 Khosla
6,083,105 A 7/2000 Ronin et al.
6,093,103 A 7/2000 McCrea, Jr.
6,113,493 A 9/2000 Walker et al.
6,117,012 A 9/2000 McCrea, Jr.
6,135,884 A 10/2000 Hedrick et al.
6,142,876 A 11/2000 Cumbers
6,146,270 A 11/2000 Huard
6,149,522 A 11/2000 Alcorn et al.
6,159,095 A 12/2000 Frohm
6,159,098 A 12/2000 Slomiany et al.
6,165,069 A 12/2000 Sines et al.
6,213,875 B1 4/2001 Suzuki
6,217,447 B1 4/2001 Lofink et al.
6,234,482 B1 5/2001 Henderson
6,241,608 B1 6/2001 Torango
6,244,596 B1 6/2001 Kondratjuk
6,251,014 B1 6/2001 Stockdale et al.
6,252,707 B1 6/2001 Kleinberger et al.
6,254,481 B1 7/2001 Jaffe
6,254,484 B1 7/2001 McCrea, Jr.
6,264,561 B1 7/2001 Saffari
6,279,910 B1 8/2001 De
6,293,864 B1 9/2001 Romero
6,312,334 B1 11/2001 Yoseloff
6,315,666 B1 11/2001 Mastera et al.
6,336,857 B1 1/2002 McBride
6,337,513 B1 1/2002 Clevenger et al.
6,345,824 B1 2/2002 Selitzky
6,346,044 B1 2/2002 McCrea, Jr.
6,347,996 B1 2/2002 Gilmore et al.
6,361,437 B1 3/2002 Walker
6,368,216 B1 4/2002 Hedrick et al.
6,375,567 B1 4/2002 Acres
6,375,576 B1 4/2002 Margerie
6,379,244 B1 4/2002 Sagawa et al.
6,394,907 B1 5/2002 Rowe
6,398,220 B1 6/2002 Inoue
6,409,602 B1 6/2002 Wiltshire
6,416,827 B1 7/2002 Chakrapani et al.
6,435,970 B1 8/2002 Baerlocher et al.
6,444,496 B1 9/2002 Edwards et al.
6,445,185 B1 9/2002 Damadian et al.
6,460,848 B1 10/2002 Soltys
6,491,583 B1 12/2002 Gauselmann
6,503,147 B1 1/2003 Stockdale et al.
6,508,709 B1 1/2003 Karmarkar
6,511,072 B1 1/2003 Santa
6,511,375 B1 1/2003 Kaminkow
6,512,559 B1 1/2003 Hashimoto et al.
6,514,141 B1 2/2003 Kaminkow et al.
6,517,073 B1 2/2003 Vancura
6,517,433 B2 2/2003 Loose et al.
6,517,436 B2 2/2003 Soltys
6,517,437 B1 2/2003 Wells et al.
6,540,230 B1 4/2003 Walker
6,547,664 B2 4/2003 Saunders
6,569,018 B2 5/2003 Jaffe
6,575,541 B1 6/2003 Hedrick et al.
6,575,834 B1 6/2003 Lindo
6,582,301 B2 6/2003 Hill
6,582,302 B2 6/2003 Romero
6,585,591 B1 7/2003 Baerlocher et al.
6,588,758 B1 7/2003 Lee
6,607,195 B2 8/2003 Vancura
6,609,978 B1 8/2003 Paulsen
6,626,757 B2 9/2003 Oliveras
6,628,244 B1 9/2003 Hirosawa
D480,961 S 10/2003 Deadman
6,646,695 B1 11/2003 Gauselmann
6,652,378 B2 11/2003 Cannon et al.
6,656,048 B2 12/2003 Olsen
6,659,864 B2 12/2003 McGahn et al.
6,659,866 B2 12/2003 Frost
6,661,425 B1 12/2003 Hiroaki
6,676,517 B2 1/2004 Beavers
6,685,567 B2 2/2004 Cockerille et al.
6,695,703 B1 2/2004 McGahn
6,702,675 B2 3/2004 Poole et al.
6,712,694 B1 3/2004 Nordman
6,712,696 B2 3/2004 Soltys
6,715,756 B2 4/2004 Inoue
6,717,728 B2 4/2004 Putilin
6,719,291 B1 4/2004 Dekeller
6,722,979 B2 4/2004 Gilmore et al.
6,726,564 B2 4/2004 Hogan
6,726,565 B2 4/2004 Hughs-Baird
6,755,741 B1 6/2004 Rafaeli
6,789,801 B2 9/2004 Snow
6,800,026 B2 10/2004 Cannon
6,802,777 B2 10/2004 Seelig et al.
6,804,763 B1 10/2004 Stockdale et al.
6,805,628 B2 10/2004 Romero
6,808,173 B2 10/2004 Snow
6,817,945 B2 11/2004 Seelig et al.
6,817,946 B2 11/2004 Motegi et al.
6,837,494 B2 1/2005 Lee
6,863,608 B1 3/2005 LeMay et al.
6,866,586 B2 3/2005 Oberberger et al.
6,887,157 B2 5/2005 LeMay et al.
6,890,259 B2 5/2005 Breckner et al.
6,896,614 B2 5/2005 Romero
6,899,625 B2 5/2005 Luciano
6,906,762 B1 6/2005 Witehira et al.
6,916,245 B1 7/2005 Vancura
6,937,298 B2 8/2005 Okada
7,008,319 B2 3/2006 Montgomery
7,029,395 B1 4/2006 Baerlocher
7,070,505 B2 7/2006 Vancura
7,114,724 B2 10/2006 Ritzer
7,128,647 B2 10/2006 Muir
7,189,161 B1 3/2007 Wiltshire
7,198,272 B2 4/2007 Duhamel
7,204,753 B2 4/2007 Ozaki et al.
7,213,812 B2 5/2007 Schubert
7,220,181 B2 5/2007 Okada
7,226,040 B2 6/2007 Keister
7,252,288 B2 8/2007 Seelig et al.
7,255,643 B2 8/2007 Ozaki et al.
7,264,241 B2 9/2007 Schubert
7,285,048 B2 10/2007 Karmarkar
7,303,473 B2 12/2007 Rowe
7,303,475 B2 12/2007 Britt
7,309,065 B2 12/2007 Yoseloff
7,309,284 B2 12/2007 Griswold et al.
7,311,604 B2 12/2007 Kaminkow
7,316,398 B1 1/2008 Pham
7,316,615 B2 1/2008 Soltys
7,322,884 B2 1/2008 Emori et al.
7,325,806 B1 2/2008 Feola
7,326,115 B2 2/2008 Baerlocher
7,329,179 B2 2/2008 Baerlocher
7,329,181 B2 2/2008 Hoshino et al.
7,351,146 B2 4/2008 Kaminkow
7,361,090 B2 4/2008 Lin
7,367,884 B2 5/2008 Breeding
7,387,570 B2 6/2008 Randall
7,404,765 B2 7/2008 Soltys
7,407,438 B2 8/2008 Schubert
7,419,160 B1 9/2008 D'Ambrosio
7,434,805 B2 10/2008 Grauzer
7,451,987 B1 11/2008 Feola
7,452,270 B2 11/2008 Walker et al.
7,465,227 B2 12/2008 Baerlocher
7,470,185 B2 12/2008 Baerlocher
7,488,251 B2 2/2009 Kaminkow
7,503,849 B2 3/2009 Hornik et al.
7,537,456 B2 5/2009 Snow
7,566,274 B2 7/2009 Johnson et al.
7,572,183 B2 8/2009 Olivas
7,575,512 B2 8/2009 Kennedy
7,584,967 B2 9/2009 Webb

(56) References Cited

U.S. PATENT DOCUMENTS 7,591,726 B2 9/2009 Baerlocher et al.
7,591,728 B2 9/2009 Gioia
7,614,948 B2 11/2009 Saffari
7,618,319 B2 11/2009 Casey et al.
7,621,533 B2 11/2009 Kenny
7,666,086 B2 2/2010 Baerlocher
7,666,087 B2 2/2010 Hughs-Baird
7,699,698 B2 4/2010 Randall
7,731,586 B2 6/2010 Letovsky
7,735,657 B2 6/2010 Johnson
7,753,798 B2 7/2010 Soltys
7,758,419 B2 7/2010 Rowe et al.
7,762,889 B2 7/2010 Shigeta
7,769,232 B2 8/2010 Downs
7,775,524 B2 8/2010 Lutnick et al.
7,775,868 B2 8/2010 Toyoda
7,780,515 B2 8/2010 Okada
7,789,743 B2 9/2010 Walker et al.
7,819,744 B2 10/2010 Hughs-Baird
7,822,641 B2 10/2010 Abbott et al.
7,828,643 B2 11/2010 Baerlocher
7,837,547 B2 11/2010 Cannon
7,846,018 B2 12/2010 Baerlocher
7,867,077 B2 1/2011 Baerlocher et al.
7,878,892 B2 2/2011 Sines et al.
7,905,771 B2 3/2011 Walker et al.
7,905,774 B2 3/2011 Walker et al.
7,909,688 B2 3/2011 Yoshizawa
7,914,368 B2 3/2011 Chun
7,914,372 B2 3/2011 Tessmer et al.
7,918,723 B2 4/2011 Chun
7,922,587 B2 4/2011 Chun
7,931,531 B2 4/2011 Oberberger
7,950,993 B2 5/2011 Oberberger
7,963,845 B2 6/2011 Baerlocher
7,967,674 B2 6/2011 Baerlocher
7,976,378 B2 7/2011 Baerlocher
7,980,948 B2 7/2011 Rowe et al.
8,002,281 B2 8/2011 Kearns
8,020,866 B2 9/2011 Walker et al.
8,066,564 B2 11/2011 Randall
8,087,984 B2 1/2012 Okujyo
8,087,985 B2 1/2012 Katz
8,087,999 B2 1/2012 Oberberger et al.
8,109,821 B2 2/2012 Kovacs
8,123,618 B2 2/2012 Karmarkar
8,128,491 B2 3/2012 Vasquez et al.
8,128,492 B2 3/2012 Vasquez et al.
8,152,617 B2 4/2012 Katz
8,152,624 B2 4/2012 Gerrard et al.
8,152,629 B2 4/2012 DeWaal et al.
8,167,711 B2 5/2012 Baerlocher
8,172,660 B2 5/2012 Lancaster et al.
8,177,627 B2 5/2012 Baerlocher
8,182,321 B2 5/2012 Chun
8,182,323 B2 5/2012 Okada
8,197,335 B2 6/2012 DeWaal et al.
8,202,153 B2 6/2012 Baerlocher
8,206,212 B2 6/2012 Iddings et al.
8,210,920 B2 7/2012 Chun
8,231,456 B2 7/2012 Zielinski
8,235,801 B2 8/2012 Tan
8,267,765 B2 9/2012 Baerlocher
8,305,550 B2 11/2012 Jung et al.
8,308,559 B2 11/2012 Chun
8,313,373 B2 11/2012 Walker et al.
8,317,589 B2 11/2012 Tessmer et al.
8,323,105 B2 12/2012 Chun
8,342,954 B2 1/2013 Oberberger et al.
8,360,852 B2 1/2013 Randall
8,360,859 B2 1/2013 Walker et al.
8,403,740 B2 3/2013 Kovacs et al.
8,425,305 B2 4/2013 Baerlocher et al.
8,430,735 B2 4/2013 Oberberger
8,430,739 B2 4/2013 Rodgers
8,454,427 B2 6/2013 Baerlocher
8,460,095 B2 6/2013 Tan
8,474,820 B2 7/2013 Walker et al.
8,485,888 B2 7/2013 Baerlocher
8,496,521 B2 7/2013 Randall
8,500,533 B2 8/2013 Lutnick et al.
8,506,380 B2 8/2013 Hughes et al.
8,517,824 B2 8/2013 Zielinski et al.
8,613,650 B2 12/2013 Kovacs et al.
8,668,564 B2 3/2014 Chun
8,956,210 B2 2/2015 Chun
9,058,716 B2 6/2015 Rajaraman
9,135,775 B2 9/2015 Pececnik
9,214,056 B2 12/2015 Kovacs et al.
9,230,398 B2 1/2016 Chun
9,240,095 B2 1/2016 Chun
9,311,773 B2 4/2016 Chun
9,704,348 B2 7/2017 Chun
9,940,777 B2 * 4/2018 Chun ..... A63F 3/00157
9,940,778 B2 * 4/2018 Chun ..... G07F 17/3225
2001/0000118 A1 4/2001 Sines
2001/0013681 A1 8/2001 Bruzzese et al.
2001/0029200 A1 10/2001 Romero
2002/0002070 A1 1/2002 Romero
2002/0002073 A1 1/2002 Montgomery
2002/0015489 A1 2/2002 Ben-David
2002/0036380 A1 3/2002 Perrie
2002/0045472 A1 4/2002 Adams
2002/0068635 A1 6/2002 Hill
2002/0072407 A1 6/2002 Soltys
2002/0077170 A1 6/2002 Johnson
2002/0077712 A1 6/2002 Safaei et al.
2002/0090988 A1 7/2002 Frost
2002/0094869 A1 7/2002 Harkham
2002/0111205 A1 8/2002 Beavers
2002/0115489 A1 8/2002 Jordan
2002/0147042 A1 10/2002 Vuong
2002/0147047 A1 10/2002 Letovsky
2002/0173354 A1 11/2002 Winans et al.
2003/0003997 A1 1/2003 Vuong et al.
2003/0013510 A1 1/2003 Vuong
2003/0027624 A1 2/2003 Gilmore et al.
2003/0032478 A1 2/2003 Takahama et al.
2003/0032479 A1 2/2003 LeMay et al.
2003/0050107 A1 3/2003 Moody
2003/0060271 A1 3/2003 Gilmore et al.
2003/0064781 A1 4/2003 Muir
2003/0067112 A1 4/2003 Grauzer
2003/0069071 A1 4/2003 Britt
2003/0073497 A1 4/2003 Nelson
2003/0087690 A1 5/2003 Loose et al.
2003/0104854 A1 6/2003 Cannon
2003/0109306 A1 6/2003 Karmarkar
2003/0130028 A1 7/2003 Aida et al.
2003/0151199 A1 8/2003 Lee
2003/0151201 A1 8/2003 Lee
2003/0176214 A1 9/2003 Burak et al.
2003/0181231 A1 9/2003 Vancura
2003/0203756 A1 10/2003 Jackson
2003/0216169 A1 11/2003 Walker
2003/0224854 A1 12/2003 Joao
2003/0232651 A1 12/2003 Huard
2003/0234489 A1 12/2003 Okada
2003/0236113 A1 12/2003 Webb
2003/0236114 A1 12/2003 Griswold et al.
2003/0236118 A1 12/2003 Okada
2004/0002379 A1 1/2004 Parrott et al.
2004/0023712 A1 2/2004 Oliver
2004/0023714 A1 2/2004 Asdale
2004/0023722 A1 2/2004 Vuong
2004/0029636 A1 2/2004 Wells
2004/0063490 A1 4/2004 Okada
2004/0066475 A1 4/2004 Searle
2004/0070146 A1 4/2004 Snow
2004/0077425 A1 4/2004 Goossens
2004/0082372 A1 4/2004 Romero
2004/0084843 A1 5/2004 Snow
2004/0087357 A1 5/2004 Johnson
2004/0090003 A1 5/2004 Snow

(56) References Cited

U.S. PATENT DOCUMENTS

| | | | |
|---|---|---|---|
| 2004/0090005 | A1 | 5/2004 | Snow |
| 2004/0108656 | A1 | 6/2004 | Snow |
| 2004/0116177 | A1 | 6/2004 | Frost |
| 2004/0116178 | A1 | 6/2004 | Okada |
| 2004/0116179 | A1 | 6/2004 | Nicely |
| 2004/0145116 | A1 | 7/2004 | Calvo et al. |
| 2004/0147303 | A1 | 7/2004 | Imura et al. |
| 2004/0147314 | A1 | 7/2004 | LeMay et al. |
| 2004/0150162 | A1 | 8/2004 | Okada |
| 2004/0162146 | A1 | 8/2004 | Ooto |
| 2004/0166925 | A1 | 8/2004 | Emori et al. |
| 2004/0166941 | A1 | 8/2004 | Fujimoto |
| 2004/0171423 | A1 | 9/2004 | Silva et al. |
| 2004/0183972 | A1 | 9/2004 | Bell |
| 2004/0185933 | A1 | 9/2004 | Nicely |
| 2004/0192430 | A1 | 9/2004 | Burak et al. |
| 2004/0198485 | A1 | 10/2004 | Loose et al. |
| 2004/0207154 | A1 | 10/2004 | Okada |
| 2004/0209666 | A1 | 10/2004 | Tashiro |
| 2004/0209667 | A1 | 10/2004 | Emori et al. |
| 2004/0209668 | A1 | 10/2004 | Okada |
| 2004/0209671 | A1 | 10/2004 | Okada |
| 2004/0209678 | A1 | 10/2004 | Okada |
| 2004/0209683 | A1 | 10/2004 | Okada |
| 2004/0214635 | A1 | 10/2004 | Okada |
| 2004/0214637 | A1 | 10/2004 | Nonaka |
| 2004/0224747 | A1 | 11/2004 | Okada |
| 2004/0224777 | A1 | 11/2004 | Smith |
| 2004/0233663 | A1 | 11/2004 | Emslie et al. |
| 2004/0235542 | A1 | 11/2004 | Stronach |
| 2004/0239582 | A1 | 12/2004 | Seymour |
| 2005/0003886 | A1 | 1/2005 | Englman |
| 2005/0032571 | A1 | 2/2005 | Asonuma |
| 2005/0037843 | A1 | 2/2005 | Wells et al. |
| 2005/0043079 | A1 | 2/2005 | Huang |
| 2005/0049032 | A1 | 3/2005 | Kobayashi |
| 2005/0049046 | A1 | 3/2005 | Kobayashi |
| 2005/0062227 | A1 | 3/2005 | Grauzer |
| 2005/0062410 | A1 | 3/2005 | Bell et al. |
| 2005/0063055 | A1 | 3/2005 | Engel |
| 2005/0073102 | A1 | 4/2005 | Yoseloff |
| 2005/0079913 | A1 | 4/2005 | Inamura |
| 2005/0085292 | A1 | 4/2005 | Inamura |
| 2005/0153772 | A1 | 7/2005 | Griswold et al. |
| 2005/0153775 | A1 | 7/2005 | Griswold et al. |
| 2005/0176493 | A1 | 8/2005 | Nozaki et al. |
| 2005/0176507 | A1 | 8/2005 | Ephrati et al. |
| 2005/0192090 | A1 | 9/2005 | Muir et al. |
| 2005/0192099 | A1 | 9/2005 | Nguyen et al. |
| 2005/0206582 | A1 | 9/2005 | Bell et al. |
| 2005/0208994 | A1 | 9/2005 | Berman |
| 2005/0218597 | A1 | 10/2005 | Parsadaian |
| 2005/0233794 | A1 | 10/2005 | Cannon |
| 2005/0233799 | A1 | 10/2005 | LeMay et al. |
| 2005/0233803 | A1 | 10/2005 | Yang |
| 2005/0239539 | A1 | 10/2005 | Inamura |
| 2005/0266912 | A1 | 12/2005 | Sekiguchi |
| 2005/0282618 | A1 | 12/2005 | OHalloran |
| 2005/0282625 | A1 | 12/2005 | Nicely |
| 2005/0285337 | A1 | 12/2005 | Durham et al. |
| 2006/0009283 | A1 | 1/2006 | Englman |
| 2006/0030399 | A1 | 2/2006 | Baerlocher |
| 2006/0033267 | A1 | 2/2006 | Wong |
| 2006/0040733 | A1 | 2/2006 | Baerlocher |
| 2006/0052149 | A1 | 3/2006 | Bursill |
| 2006/0052168 | A1 | 3/2006 | Shacham |
| 2006/0063577 | A1 | 3/2006 | Downs |
| 2006/0071429 | A1 | 4/2006 | Okujyo |
| 2006/0073882 | A1 | 4/2006 | Rozkin et al. |
| 2006/0092170 | A1 | 5/2006 | Bathiche et al. |
| 2006/0100014 | A1 | 5/2006 | Griswold et al. |
| 2006/0103071 | A1 | 5/2006 | Ritzer |
| 2006/0103951 | A1 | 5/2006 | Bell et al. |
| 2006/0125745 | A1 | 6/2006 | Evanicky |
| 2006/0128472 | A1 | 6/2006 | Beavers |
| 2006/0135240 | A1 | 6/2006 | Barshack |
| 2006/0135243 | A1 | 6/2006 | Englman |
| 2006/0148547 | A1 | 7/2006 | Montgomery |
| 2006/0166726 | A1 | 7/2006 | Chun |
| 2006/0166727 | A1 | 7/2006 | Burak |
| 2006/0166731 | A1 | 7/2006 | Yoshimi |
| 2006/0178181 | A1 | 8/2006 | Chun |
| 2006/0189382 | A1 | 8/2006 | Muir et al. |
| 2006/0191177 | A1 | 8/2006 | Engel |
| 2006/0226605 | A1 | 10/2006 | Kenny |
| 2006/0258446 | A1 | 11/2006 | Nguyen et al. |
| 2006/0284574 | A1 | 12/2006 | Emslie et al. |
| 2006/0287042 | A1 | 12/2006 | Osawa |
| 2006/0287058 | A1 | 12/2006 | Resnick |
| 2006/0290594 | A1 | 12/2006 | Engel et al. |
| 2007/0004510 | A1 | 1/2007 | Underdahl et al. |
| 2007/0010315 | A1 | 1/2007 | Hein |
| 2007/0013127 | A1 | 1/2007 | Ellis |
| 2007/0018406 | A1 | 1/2007 | Kennedy |
| 2007/0021198 | A1 | 1/2007 | Muir et al. |
| 2007/0026922 | A1 | 2/2007 | Lindo |
| 2007/0026947 | A1 | 2/2007 | Chun |
| 2007/0032283 | A1 | 2/2007 | Chun |
| 2007/0060259 | A1 | 3/2007 | Pececnik |
| 2007/0117604 | A1 | 5/2007 | Hill |
| 2007/0129123 | A1 | 6/2007 | Eryou et al. |
| 2007/0135204 | A1 | 6/2007 | Nicely |
| 2007/0155512 | A1 | 7/2007 | Wells |
| 2007/0218968 | A1 | 9/2007 | Snow |
| 2007/0243927 | A1 | 10/2007 | Soltys |
| 2007/0243929 | A1 | 10/2007 | Skotarczak |
| 2007/0243935 | A1 | 10/2007 | Huizinga |
| 2008/0001358 | A1 | 1/2008 | Scott |
| 2008/0009334 | A1 | 1/2008 | Walker |
| 2008/0020816 | A1 | 1/2008 | Griswold et al. |
| 2008/0020839 | A1 | 1/2008 | Wells et al. |
| 2008/0020840 | A1 | 1/2008 | Wells et al. |
| 2008/0020841 | A1 | 1/2008 | Wells et al. |
| 2008/0026807 | A1 | 1/2008 | Moshal |
| 2008/0045288 | A1 | 2/2008 | Moshal |
| 2008/0064467 | A1 | 3/2008 | Reiner |
| 2008/0076499 | A1 | 3/2008 | Lowery |
| 2008/0085769 | A1 | 4/2008 | Lutnick |
| 2008/0108400 | A1 | 5/2008 | Chun |
| 2008/0113778 | A1 | 5/2008 | Chun |
| 2008/0113783 | A1 | 5/2008 | Czyzewski |
| 2008/0146311 | A1 | 6/2008 | Walker |
| 2008/0146344 | A1 | 6/2008 | Rowe et al. |
| 2008/0149705 | A1 | 6/2008 | Giobbi et al. |
| 2008/0182650 | A1 | 7/2008 | Randall et al. |
| 2008/0194334 | A1 | 8/2008 | Kuok |
| 2008/0214274 | A1 | 9/2008 | Thomas |
| 2008/0230993 | A1 | 9/2008 | Chun |
| 2008/0231611 | A1 | 9/2008 | Bathiche et al. |
| 2008/0248865 | A1 | 10/2008 | Tedesco et al. |
| 2008/0254881 | A1 | 10/2008 | Lutnick |
| 2008/0274802 | A1 | 11/2008 | Joao |
| 2008/0280667 | A1 | 11/2008 | Chun |
| 2008/0280668 | A1 | 11/2008 | Chun |
| 2008/0305855 | A1 | 12/2008 | Czyzewski |
| 2008/0318668 | A1 | 12/2008 | Ching et al. |
| 2009/0029755 | A1 | 1/2009 | Chun |
| 2009/0029766 | A1 | 1/2009 | Lutnick et al. |
| 2009/0061974 | A1 | 3/2009 | Lutnick |
| 2009/0069079 | A1 | 3/2009 | Britt |
| 2009/0075724 | A1 | 3/2009 | Breeding |
| 2009/0111573 | A1 | 4/2009 | Iddings |
| 2009/0115133 | A1 | 5/2009 | Kelly |
| 2009/0124323 | A1 | 5/2009 | Dunn |
| 2009/0124385 | A1 | 5/2009 | Cuddy |
| 2009/0137313 | A1 | 5/2009 | Young |
| 2009/0176547 | A1 | 7/2009 | Katz |
| 2009/0203433 | A1 | 8/2009 | Olivas |
| 2009/0221360 | A1 | 9/2009 | Wooding |
| 2009/0252546 | A1 | 10/2009 | Kaleta |
| 2010/0056262 | A1 | 3/2010 | Englman |
| 2010/0102511 | A1 | 4/2010 | Tammesoo |
| 2010/0105457 | A1 | 4/2010 | Miller |
| 2010/0105459 | A1 | 4/2010 | Miller |

(56) References Cited

U.S. PATENT DOCUMENTS

| | | | |
|---|---|---|---|
| 2010/0111820 | A1 | 5/2010 | Natura et al. |
| 2010/0113119 | A1 | 5/2010 | Miller |
| 2010/0117299 | A1 | 5/2010 | Nicely |
| 2010/0120506 | A1 | 5/2010 | Davis et al. |
| 2010/0130280 | A1 | 5/2010 | Arezina et al. |
| 2010/0222133 | A1 | 9/2010 | Spencer |
| 2010/0234086 | A1 | 9/2010 | Michaelson |
| 2010/0255897 | A1 | 10/2010 | Pececnik |
| 2010/0295247 | A1 | 11/2010 | LaDuca |
| 2011/0031694 | A1 | 2/2011 | Cohen |
| 2011/0039612 | A1 | 2/2011 | Pececnik |
| 2011/0059800 | A1 | 3/2011 | Anderson |
| 2011/0105207 | A1 | 5/2011 | Chun |
| 2011/0111824 | A1 | 5/2011 | Cuddy et al. |
| 2011/0120506 | A1 | 5/2011 | Sakai |
| 2011/0140362 | A1 | 6/2011 | Chun |
| 2011/0159965 | A1 | 6/2011 | Chun |
| 2012/0064958 | A1 | 3/2012 | Lisandro |
| 2012/0270625 | A1 | 10/2012 | Chun |
| 2012/0276973 | A1 | 11/2012 | Kishi |
| 2012/0289300 | A1 | 11/2012 | Chun |
| 2012/0309524 | A1 | 12/2012 | Rajaraman |
| 2013/0165201 | A1 | 6/2013 | Chun |
| 2013/0165235 | A1 | 6/2013 | Chun |
| 2013/0184044 | A1 | 7/2013 | Frost |
| 2013/0190075 | A1 | 7/2013 | Chun |
| 2013/0288764 | A1 | 10/2013 | Chun |
| 2013/0288779 | A1 | 10/2013 | Chun |
| 2014/0135088 | A1 | 5/2014 | Chun |
| 2017/0018146 | A9 | 1/2017 | Chun |
| 2017/0236369 | A1 | 8/2017 | Chun |
| 2017/0256129 | A1 | 9/2017 | Chun |
| 2017/0309116 | A1 | 10/2017 | Chun |
| 2017/0316637 | A1 | 11/2017 | Chun |
| 2017/0345261 | A1 | 11/2017 | Chun |

FOREIGN PATENT DOCUMENTS

| | | |
|---|---|---|
| EP | 1101513 | 5/2001 |
| EP | 1467329 | 10/2004 |
| EP | 1892683 | 2/2008 |
| GB | 2408696 | 6/2005 |
| GB | 2403429 | 7/2006 |
| GB | 2430385 | 3/2007 |
| JP | H0956889 | 3/1997 |
| JP | 2006181270 | 7/2006 |
| WO | 99/19027 | 4/1999 |
| WO | 99/42889 | 8/1999 |
| WO | 99/44095 | 9/1999 |
| WO | 00/79467 | 12/2000 |
| WO | 01/09664 | 2/2001 |
| WO | 01/15127 | 3/2001 |
| WO | 01/15128 | 3/2001 |
| WO | 01/15132 | 3/2001 |
| WO | 02/17841 | 3/2002 |
| WO | 2004/001486 | 12/2003 |
| WO | 2004/102520 | 11/2004 |
| WO | 2005/056134 | 6/2005 |
| WO | 2005/065793 | 7/2005 |
| WO | 2006/034192 | 3/2006 |
| WO | 2006/038819 | 4/2006 |
| WO | 2007/016035 | 2/2007 |
| WO | 2007/032945 | 3/2007 |
| WO | 2007/073534 | 6/2007 |
| WO | 2007/099334 | 3/2008 |
| WO | 2008/026950 | 3/2008 |
| WO | 2008/092385 | 8/2008 |
| WO | 2009/107131 | 9/2009 |
| WO | 2014/067389 | 5/2014 |

OTHER PUBLICATIONS

International Search Report for PCT/CA2006/001295, dated Nov. 2, 2006, 17 pgs.

EZ Baccarat. DP Stud, Inc., www.ezbaccarat.com, 2 pgs. (2003).

"Scarne's Encyclopedia of Card Games," by John Scarne, 1973, HarperCollins, New York, N.Y., chapter on banking games.

"Scarne's Complete Guide to Gambling," by John Scarne, 1961, Simon & Schuster, New York, N.Y., chapter on roulette.

Parlett, David. "A History of Poker." Copyright 2005. Accessed Aug. 23, 2013. 13pp. <http://www.pagat.com/poker/history.html>.

"Sic bo". Wikipedia, the free encyclopedia. First accessed Feb. 12, 2013. Current version Feb. 14, 2013. <http://en.wikipedia.org/wiki/Sic_bo>.

Macau Patent Application Notice of Allowance, Macau Patent Application I/150. Australian Examination Report No. 1 for Australian Application No. 2013347597, dated Mar. 10, 2016 (3 pages).

Australian Examination Report No. 2 for Australian Application No. 2013347597, dated Oct. 31, 2016 (2 pages).

* cited by examiner

SYSTEM FOR MONITORING AND PLAYING A PLURALITY OF LIVE CASINO TABLE GAMES

PRIORITY CLAIM

This application is a continuation of, claims priority to and the benefit of U.S. patent application Ser. No. 13/685,226, filed on Nov. 26, 2012, which is a continuation-in-part of, claims priority to and the benefit of U.S. patent application Ser. No. 13/042,633, filed on Mar. 8, 2011, which is a continuation of, claims priority to and the benefit of U.S. patent application Ser. No. 11/497,708, filed on Aug. 1, 2006, now U.S. Pat. No. 7,922,587, which is a continuation-in-part of, claims priority to and the benefit of U.S. patent application Ser. No. 11/042,732, filed on Jan. 24, 2005, now U.S. Pat. No. 7,918,723, and which is a continuation-in-part of, claims priority to and the benefit of U.S. patent application Ser. No. 11/198,218, filed on Aug. 5, 2005, and which is a continuation-in-part of, claims priority to and the benefit of U.S. patent application Ser. No. 11/312,150, filed on Dec. 19, 2005, now U.S. Pat. No. 7,914,368, the entire contents of which are each incorporated by reference herein.

BACKGROUND

The present invention is generally directed to a betting terminal for playing a game such as a baccarat game. The invention betting terminal allows players to play different games without moving from one gaming table to another. Therefore, the invention helps to maximize the time spent by players on gaming tables while they are inside a casino and also maximize the utilization of casino floor space.

Gaming is a major form of modem entertainment. For example, baccarat is one of the more popular gambling games played in casinos or gaming establishments. As is well known, the game is played on an elongated table having a game board displayed along the upper surface of the table. The game board displays certain wagering areas, and the elongated table allows for the seating of multiple players or bettors (1-16) and the positioning of the multiple dealers (3) necessary for operating the casino game. Bettor locations are typically numbered on the table and each bettor location has an area designated for a wager on the bank hand and an area designated for a wager on the player hand. Baccarat uses a standard deck of 52 playing cards and is usually dealt from a shoe having multiple decks that have been shuffled together prior to the beginning of play: A feature of conventional live games is that the betting process is limited to a single game. The simplicity of the betting process has led to a corresponding simplicity in the relatively few types of games which may be placed during in a casino, for example, which may limit interest on the part of the player(s) and thus further limit the casino in terms of profit and payout. The embodiments described below address the above-described issues and needs.

SUMMARY

Provided is a betting terminal for playing a game. The betting terminal comprises a network of terminals linked to different game tables where each of the terminals comprises a mechanism to switch on a plurality of games. A player at one terminal can switch to different tables and place bets at different games at a time. The games can be games of the same kind or games of different kind.

In some embodiments, a betting terminal can serve as a platform for placing bets in games like baccarat, roulette, sicbo ("dice game") as well as other common casino table games which are operated at tables linked to game and payout servers and betting terminals through an intranet. In some embodiments, the roulette and sicbo table games can be operated automatically or by human dealers, but the betting results shall be recorded automatically or manually and sent to game and payout servers electronically to allow automatic payout process.

The present invention also provides a software program or a set of software programs for carrying out any or all steps of the betting method described herein. The baccarat game can also be incorporated into an electronic device or an entertainment gaming machine. Representative electronic devices include, but are not limited to, laptop computers or desktop computers.

DETAILED DESCRIPTION

Provided is a betting terminal for playing a game. The betting terminal comprises a network of terminals linked to different game tables where each of the terminals comprises a mechanism to switch on a plurality of games. A player at one terminal can switch to different tables and place bets at different games at a time. The games can be games of the same kind or games of different kind.

Figure 1:
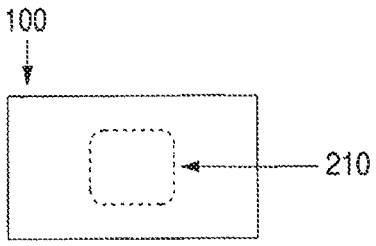
FIG. 1 shows an illustrative scheme of the betting terminal described herein.
Figure 2:
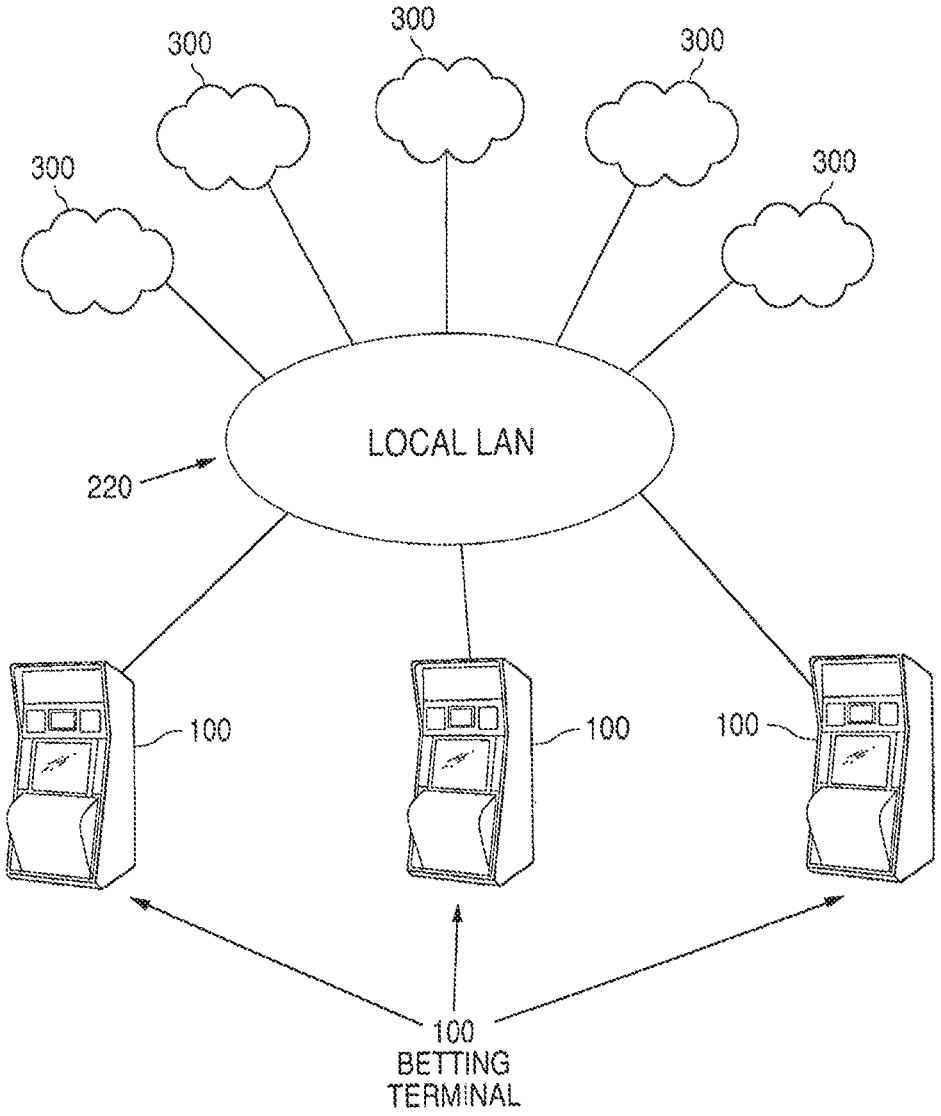
FIG. 2 shows an illustrative scheme of a betting system of the present invention.

The betting terminal can be linked to different types of games. An illustrative general scheme of the betting terminal 100 is described in FIG. 1, which includes a switching mechanism 200 allowing a player to select a game to play. The switching mechanism 200 (not shown) can further include a game indicator 210 showing the type of game selected. The switching mechanism can be located in anywhere of the betting terminal. In some embodiments, the betting terminal is linked to a plurality of game tables. An illustrative general layout of a gaming system via a betting terminal of the present invention is provided by FIG. 2. In FIG. 2, a plurality of betting terminals (100) (three betting terminal are listed as examples) are linked via a network (220) to a plurality of game tables (300). The game tables can be conventional baccarat game tables, jackpot baccarat game tables as described in the U.S. application Ser. No. 11/042,732, filed on Jan. 24, 2005, Ser. No. 11/198,218, filed on Aug. 5, 2005 and Ser. No. 11/312,150, filed on Dec. 19, 2005, and Macau Patent Application Nos. 1/150, filed on Feb. 4, 2005 and 1/265, filed on Jan. 24, 2006, the teachings of which are incorporated herein by reference. In some embodiments, the game tables can be any game tables played in a casino or internet.

In one embodiment, the betting terminal described herein is one for baccarat. For example, a baccarat gaming system that allows one to play a live baccarat jackpot as described in the U.S. application Ser. No. 11/042,732, filed on Jan. 24, 2005, Ser. No. 11/198,218, filed on Aug. 5, 2005 and Ser. No. 11/312,150, filed on Dec. 19, 2005, and Macau Patent Application Nos. 1/150, filed on Feb. 4, 2005 and 1/265, filed on Jan. 24, 2006, the teachings of which are incorporated herein by reference.

Figure 3:
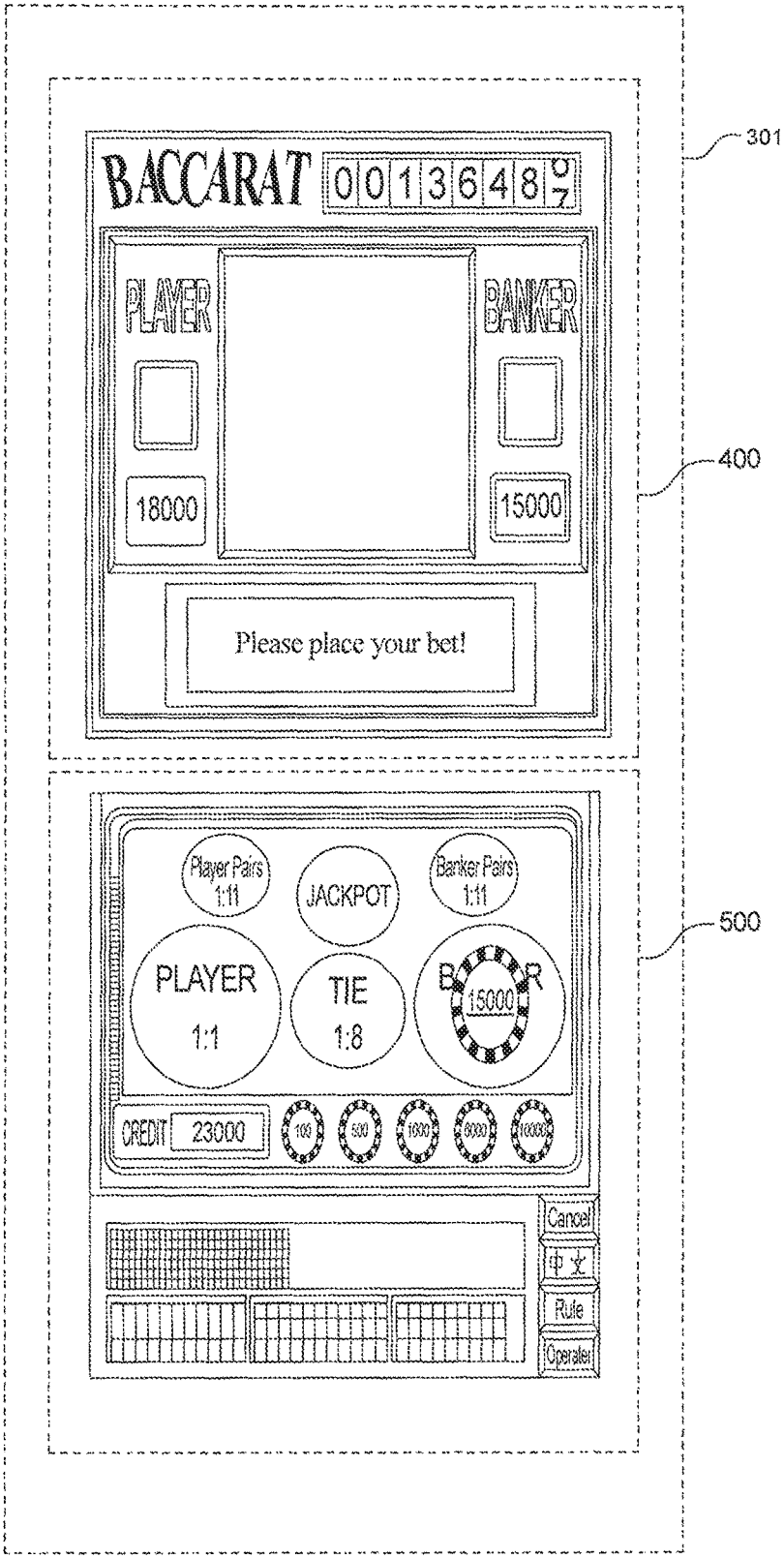
FIG. 3 shows a general layout of a betting terminal for live jackpot baccarat game.
Figure 4A:
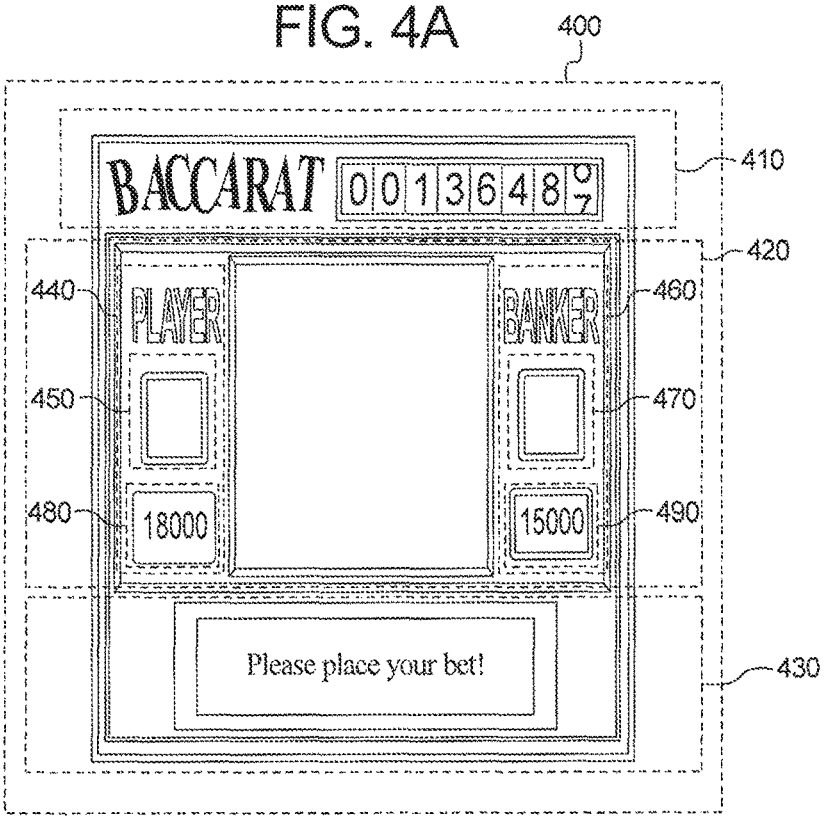
FIGS. 4A, 4B, 4C and 4D show the detailed layout of a betting terminal for a baccarat machine.
Figure 4B:
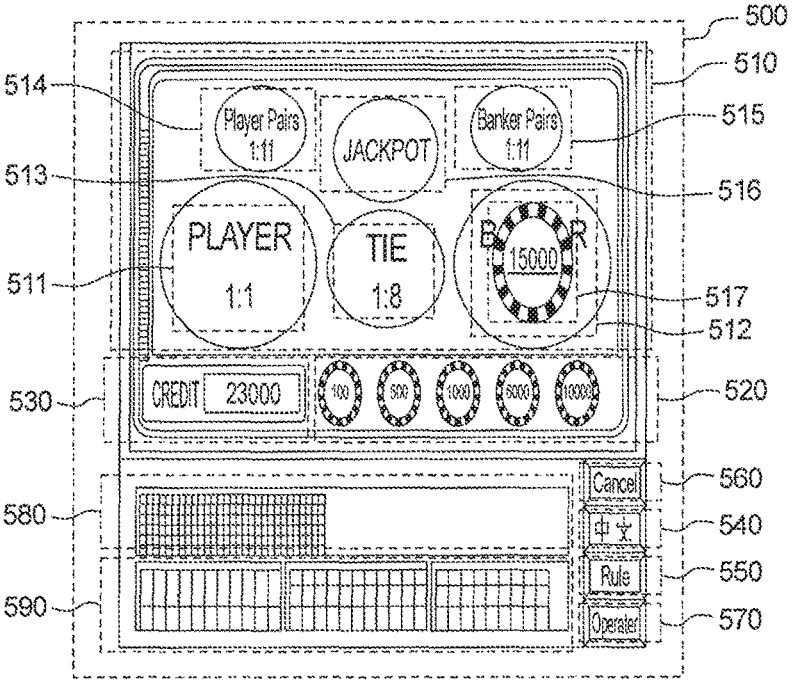

A general layout of a betting terminal for a live jackpot baccarat game is shown in FIG. 3, FIGS. 4A and 4B. FIG. 3 shows the overall layout of the betting terminal (301), which has two screens, the upper screen (400) and the lower screen (500), shown in detail in FIGS. 4A and 4B, and a switching mechanism 200, which is not shown. Referring to FIG. 4A, upper screen 400 includes an display part (410) for displaying the rolling amount of jackpot, the center part (420) for displaying a live video of the gambling table, and a messenger screen (430) for displaying messages or game cards. The center part of the upper screen has a left section designated as Player (440), which has a small screen (450), and right section 10 designated as Banker (460), which also has a small screen (470). The small screens 450 and 470 are for display of card values of the player hand and the bank hand respectively. The current limits available for betting on Player (player hand) and Banker (bank hand) in a live baccarat game are shown in small screens 480 and 490 below small screens 450 and 470, respectively. Referring to FIG. 4B, the lower screen 500 is an operating touch screen for betting, which includes bet-option buttons (510), bet-amount buttons (520), and credit window (530). The bet-option buttons 510 include the various betting selections described above, e.g., betting for player hand (511) win with a payoff rate of 1:1, for the bank hand (512) win with a payoff rate of 1:0.95, for tie (513) with a payoff rate of 20 1:8, for Player Pairs (514) with a payoff rate of 1:11, for banker pairs (515) with a payoff rate of 1:11,and for Jackpot bet (516), the rules of which are described above. Box 517 shows the pops up when bets are placed on a particular bet option. The number inside Box 517 corresponds to the amount placed on a particular bet option. The bet-amount buttons 520 as shown in the layout, 100,500, 1000,5000, 10000, provide the players the convenience of adding up betting amounts in a fast manner.

To illustrate, for a bet of 10,000 USD or HKD, the player can simply press the "1000" button ten times to reach the desired betting amount. Note, the bet-amount buttons 520 shown are illustrative and non-exclusive. Buttons designated for other amounts, e.g., "1", "5", "10", "100", "100,000", "1,000,000" can be readily added to the screen. The credit window 530 shows the remaining balance of a player's credit. The player may insert bills or chips into or transfer money from a credit card account and/or a bank account to the machine to add up the credit amount from time to time. If the player desires to stop playing the baccarat game and to cash out, he may ask the operator to authorize a cash-out procedure, and then obtain the remaining balance. Still referring to FIG. 4B, the lower screen 500 further includes language selection button (540), which can switch the operation language of the baccarat game between, e.g., Chinese, English, Portuguese, Italian, French, Spanish, Russian, German, Arabic, Japanese, and Korean, etc, Rule selection button (550), which prompts the display of rules for live baccarat and Paradise Jackpot™, Cancel button (560), which allows the bettor to cancel all bets made before he presses the confirmation button on the top right hand corner of the lower screen. Operator button (570), which allows the bettor to call for assistance from the casino staff when there is machine failure or the bettor wishes to exit from the game, and Results Bars (580, 590) which display the results for previous games (e.g. live baccarat games). Once results of a game are confirmed, the losing bet shown in the bet option buttons (510) in the center of lower screen will disappear while the winning bet in the bet option buttons (510) in the lower screen will flash and a diagram will pop up with detailed breakdown of the payouts for each of the bet options won.

Figure 4C:
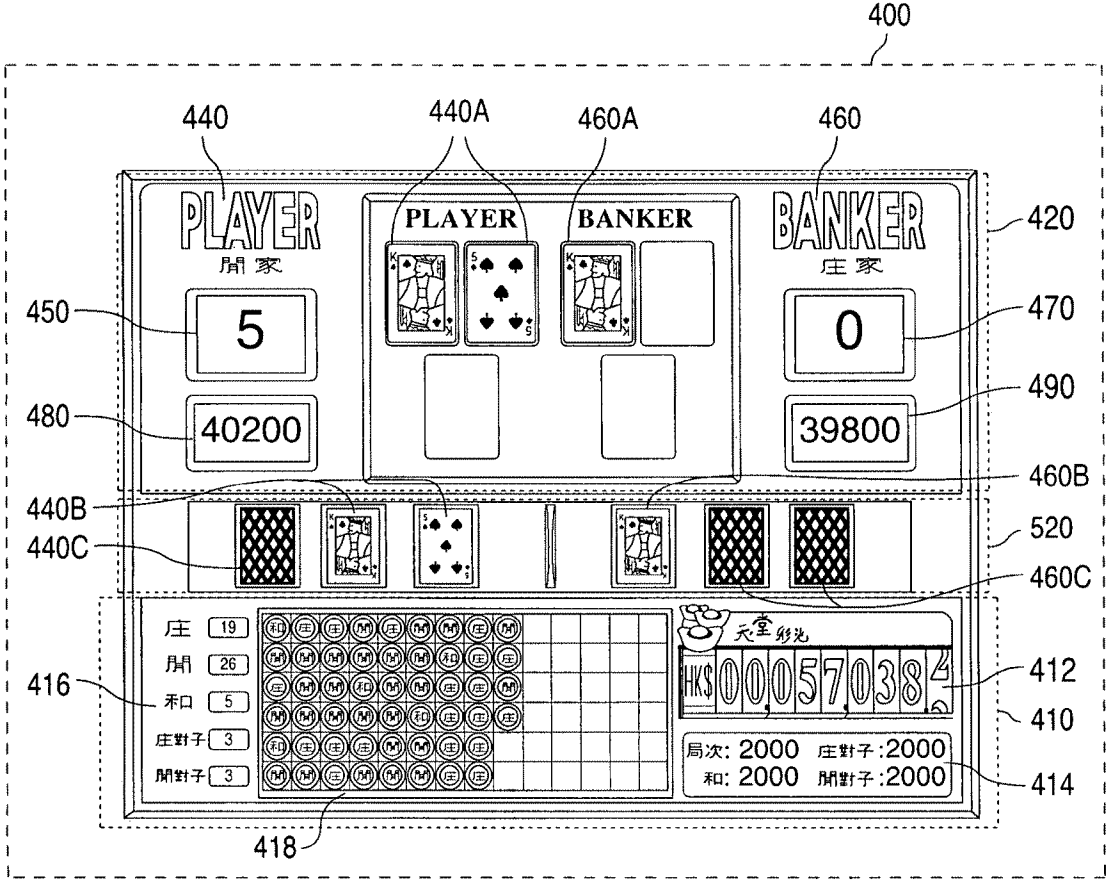
Figure 4D:
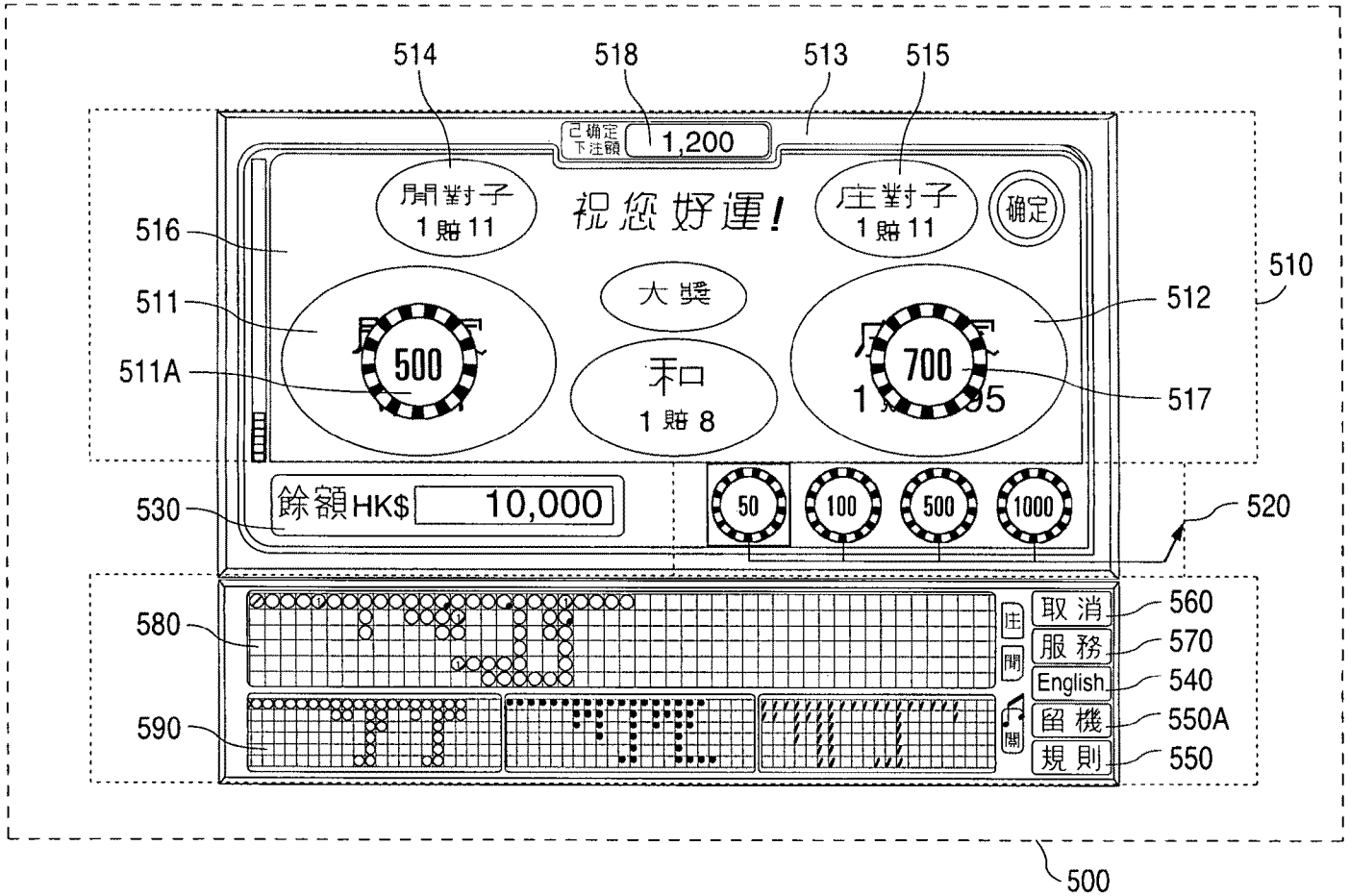

FIGS. 4C and 4D show two variants of the design of the betting terminal similar to the embodiment as described in FIGS. 4A-4B. Referring to FIG. 4C, upper screen 400 includes a display part (410) for displaying the baccarat game result and rolling amount of jackpot, a display part (420) for displaying a live video of the gambling table, and a messenger screen (430) for displaying game cards. The display 10 part 420 has a left section designated as Player (440), which has a small screen (450), and right section designated as Banker (460), which also has a small screen (470).

The small screens 450 and 470 are for display of card values of the player hand and the bank hand respectively. The current limits available for betting on Player (player hand) and Banker (bank hand) in a live baccarat game are shown in small screens 480 and 490 below small screens 450 and 470, respectively. Still referring to FIG. 4C, the display part 420 can display Player game cards 440A and Banker game cards 460A. The messenger screen 430 shows game cards directly from a shoe in a baccarat game (not shown), 440B and 440C for the Player, and 460B and 460C for the Banker. The game cards 440A and 440B correlate to each other can have the same or different appearance. Similarly, the game cards 460A and 460B correlate to each other can have the same or different appearance. Preferably, game cards 440A, 440B, 440C, 460A, 460B and 460C are shown directly from a shoe in a baccarat game (not shown).

Still referring to FIG. 4C, the display part 410 includes a screen (412) for showing jackpot amount, display 414 showing game number (e.g., game No. 52) and respective amounts available for betting on banker pairs, player pairs or tie, display 416 showing the frequency of bank hand win, player hand win and tie in past games, and display 418 showing the sequence of bank hand win, player hand and tie in past games.

Referring to FIG. 4D, the lower screen 500 is an operating touch screen for betting, which includes bet-option buttons (510), bet-amount buttons (520), and credit window (530). The bet-option buttons 510 include the various betting selections described above, e.g., betting for player hand (511) win with a payoff rate of 1:1, for the bank hand (512) win with a payoff rate of 1:0.95, for tie (513) with a payoff rate of 1:8, for Player Pairs (514) with a payoff rate of 1:11, for banker pairs (515) with a payoff rate of 1:11, and for Jackpot bet (516), the rules of which are described above. Box (511A) and Box (517) show the pops up when bets are placed on a particular bet option. The number inside Box 511A corresponds to the amount placed on a particular bet option on a player hand win. The number inside Box 517 corresponds to the amount placed on a particular bet option on banker hand win. Display screen (518) shows the total accepted amount of bets placed on all bet options. The bet-amount buttons 520 as shown in the layout, 50, 100, 500, 1000, provide the players the convenience of adding up betting amounts in a fast manner. Note, the bet-amount buttons 520 shown are illustrative and non-exclusive. Buttons designated for other amounts, e.g., "1", "5", "10", "100", "100,000", "1,000,000" can be readily added to the screen. The credit window 530 shows the remaining balance of a player's credit. The player may insert bills or chips into or transfer money from a credit card account and/or a bank account to the machine to add up the credit amount from time to time. If the player desires to stop playing the baccarat game and to cash out, he may ask the operator to authorize a cash-out procedure, and then obtain the remaining balance. Still referring to FIG. 4D, the lower screen 500 further includes language selection button (540), which currently is in Chinese and can switch the operation language of the betting table between, e.g., Chinese, English, Portuguese, Italian, French, Spanish, Russian, German, Arabic, Japanese, and Korean, etc., Rule selection button (550), which prompts the display of rules for a selected game (e.g., a live baccarat and Paradise Jackpot™), Stand-by button 550A to lock the betting terminal if the better wishes to leave the terminal for a short period of time, Cancel button (560), which allows the bettor to cancel all bets made before he presses the confirmation button on the top right hand corner of the lower screen., Operator button (570), which allows the bettor to call for assistance from the casino staff when there is machine failure or the bettor wishes to exit from the game, and Results Bars (580, 590) which display the results for previous live baccarat games. Once results of a game are confirmed, the losing bet shown in the bet option buttons (510) in the center of lower screen will disappear while the winning bet in the bet option buttons (510) in the lower screen will flash and a diagram will pop up with detailed breakdown of the payouts for each of the bet options won.

Figure 4E:
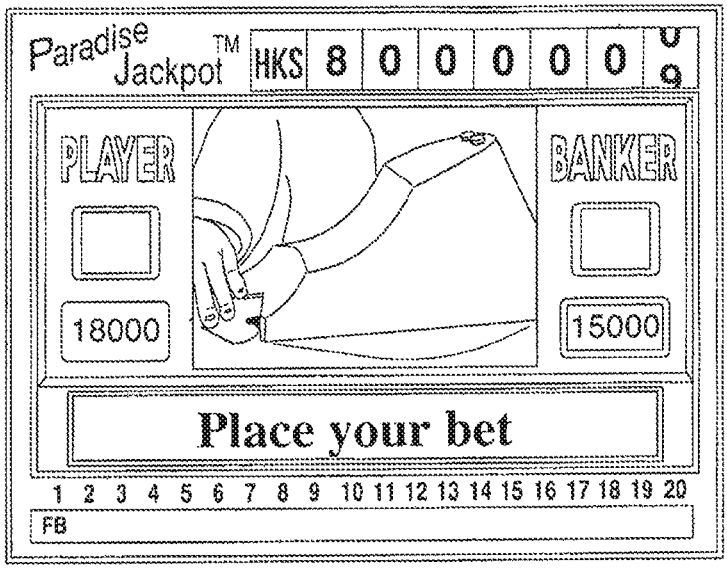
FIGS. 4E, 4F, 4G and 4H show variants of the layout of the betting terminal shown in FIGS. 4A-4D.
Figure 4F:
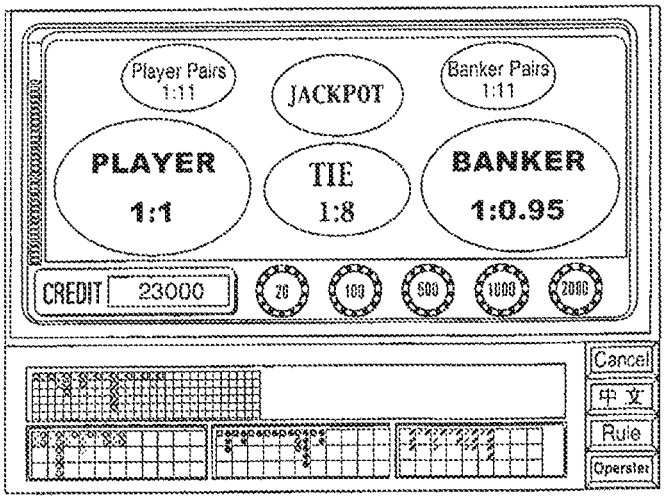
Figure 4G:
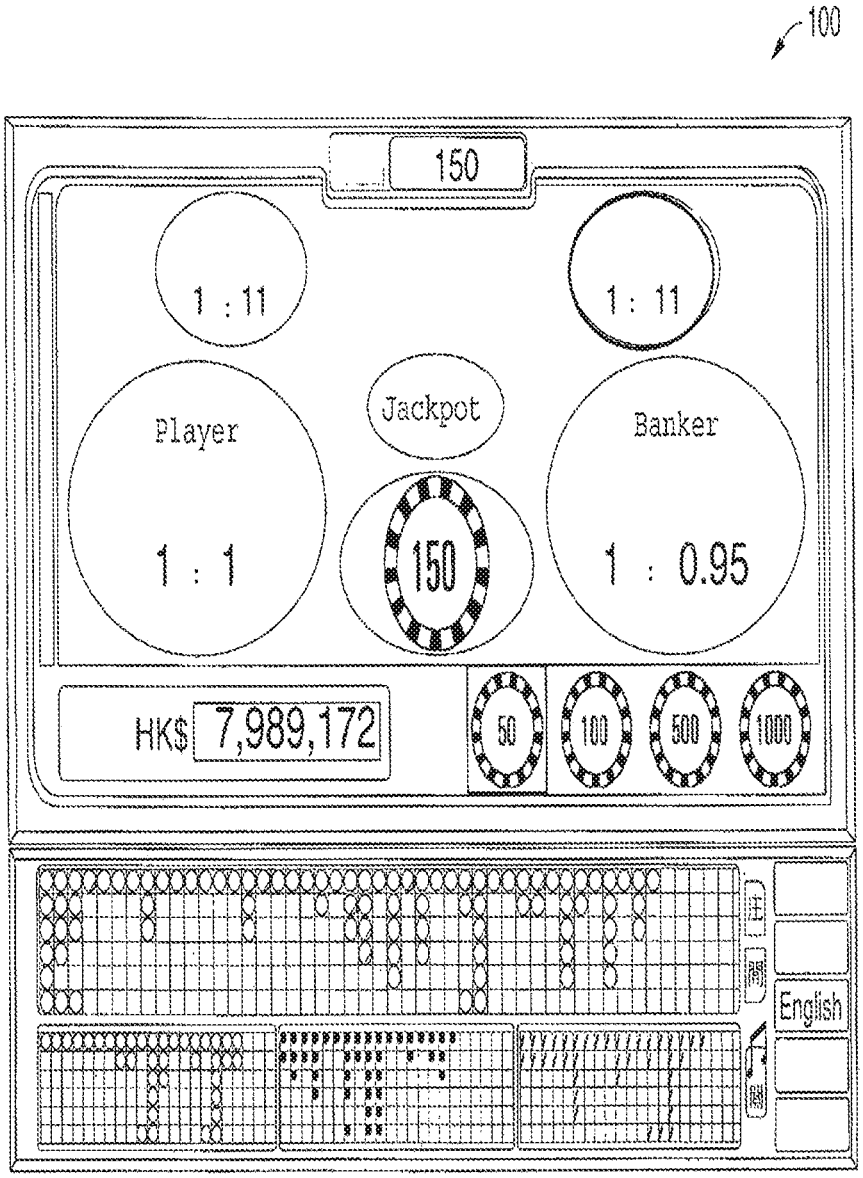
Figure 4H:
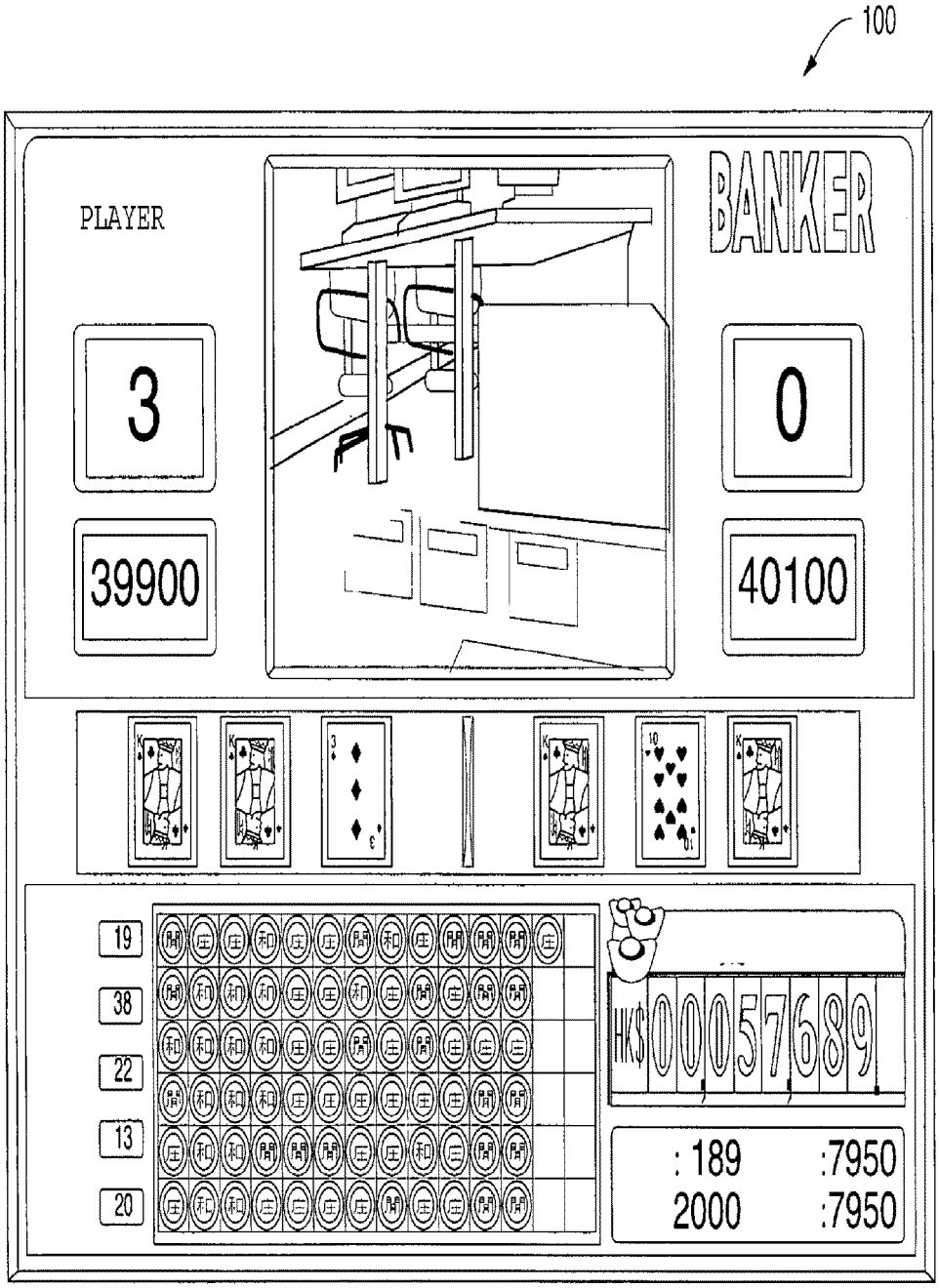

FIGS. 4F and 4H are alternative designs of the upper screen 400 as shown in FIG. 4A, which has a similar layout as the one shown in FIG. 4A except that the top left corner of the upper screen displays the words "Paradise Jackpot™" and the bottom rim has a blank bar and numbers 1 through 20 for showing the result of past games on top of the bar. FIGS. 4E and 4G are alternative designs of the lower screen of 500 as shown in FIG. 4B, which as a similar layout as the one shown in FIG. 4B except that the top rim of the lower screen 500 bears letters indicating the left side as the Player side and the right side and the Banker side, a screen at the far up-left corner indicating the maximum bet on the player hand accepted by the dealing table in a game, and a screen at the far up-right corner indicating the maximum bet on the banker hand accepted by the dealing table in a game.

Figure 5A:
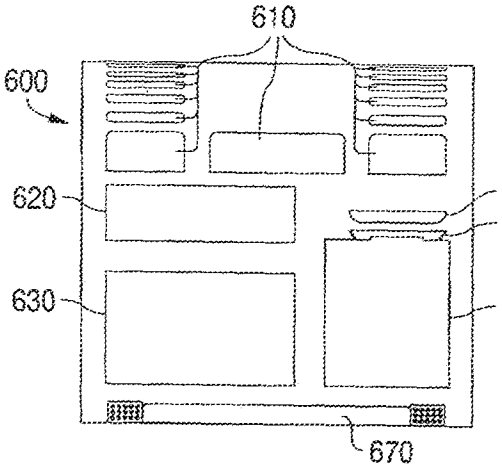
FIGS. 5A, 5B, 5C, 5D and 5E show an embodiments of the overall design of the betting terminal.
Figure 5B:
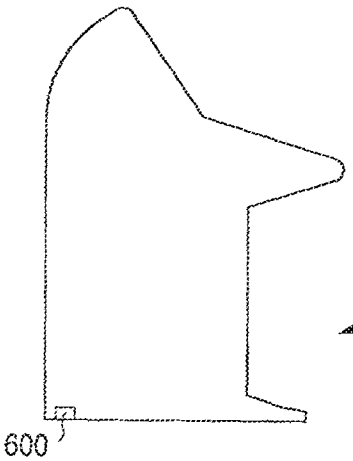
Figure 5C:
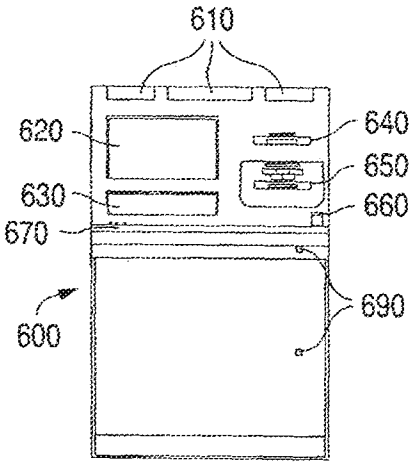
Figure 5D:
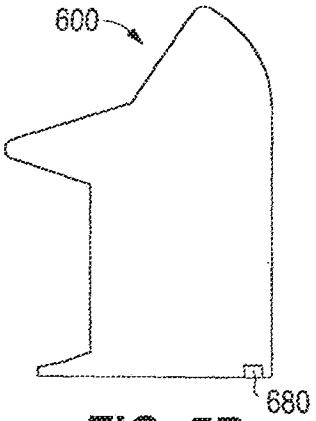
Figure 5E:
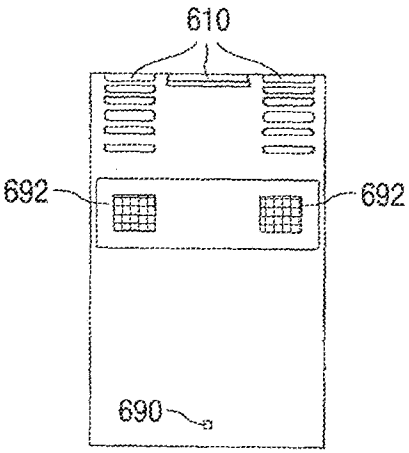

FIG. 5A shows an embodiment of the top layout betting terminal of the present invention. The top layout includes information Lamp 610, which can be color-changeable LED and flashes when a player wins a betting option, an upper screen 620, bottom screen 630, a ticket printer slot 640, a bill slot 650, table 660 for holding beverage drinks or ashtray, and speaker 670. In some embodiments, the ticket printer can print out ticket with bar code. In some embodiments, a player can also insert ticket with bar code to increase the credit amount that a play may have in a betting game. FIGS. 5B and 5D show two side views of the betting terminal, showing a cable path. FIG. 5C shows a front view of the betting terminal, showing the top layout described in FIG. 5A and speaker 670. FIG. 5E shows a back view of the betting terminal of this embodiment, showing Lamp 610, lock mechanism 690 and fan 692. In an embodiment, three betting terminals can be clustered in a unit. In some embodiments, the betting system can automatically generate commonly accepted format of past results of played games on the screen to provide references for players.

The betting terminal described above can be embodied in any form. In some embodiments, the betting terminal can be a device. In some embodiments, the betting terminal can be a virtual terminal. One of ordinary skill in the art can readily construct the betting terminal described herein.

The betting terminal described above can be used in any gaming system. In some embodiments, a betting terminal can serve as a platform for placing bets in games like baccarat, roulette, sicbo ("dice game") as well as other common casino table games which are operated at tables linked to game and payout servers and betting terminals through an intranet. In some embodiments, the roulette and sicbo table games can be operated automatically or by human dealers, but the betting results shall be sent to game and payout servers electronically to allow automatic payout process.

In some embodiments, the gaming system can further include a device on each dealing table to record the betting results automatically or manually and send the results to server for computation of payouts. In some embodiments, such a device can be, for examples, electronic scanning or reading devices known in the art, card dealing shoe with scanning device to read the cards, electronic detecting device to identify ball location on a roulette and image recognition device for reading results of a dice game.

In some embodiments, the gaming system is a baccarat gaming system. The gaming system can include a dealing table comprising a touch screen. The dealing table allows a dealer to perform a dealing process. The touch screen can prompt the dealer of the dealing process. In some embodiments, the touch screen can provide dealing instructions. The games that can be played via the betting terminal described herein in game tables or terminals located within a single gaming establishment or throughout multiple gaming establishments. The game tables or terminals can be linked together by wire or wireless linking or connecting mechanisms. In some embodiments such linking mechanisms can be electric and/or optical cable. In some embodiments, the linking mechanism can be internet or intranet.

In some embodiments, the present invention also provides a software program or a set of software programs for carrying out any or all steps of the betting method described herein. The baccarat game can also be incorporated into an electronic device or an entertainment gaming machine. Representative electronic devices include, but are not limited to, laptop computers or desktop computers. In some embodiments, such electronic devices can be a cell phone, a blackberry device or a hand held device such as hand held personal computer (PC) or personal data assistants (PDAs). The betting table and system described above can be readily constructed by an artisan of ordinary skill.

A casino system for playing a live casino table game, comprising: a plurality of game tables, each game table allowing a dealer dealing cards according to conventional gaming rules; a plurality of electronic handheld devices remotely located from the game tables, each electronic handheld device is configured to display a video of at least one game taking place at the plurality of game tables; a gaming server; and a network operatively coupling the gaming server to the game tables and the electronic handheld devices; wherein each electronic handheld device includes a display part comprising: a video display area, the video display area configured to display a video of at least one game taking place at the plurality of game tables; and a player wagering display area having a touch screen input configured to display a plurality of touch screen results bars, each said touch screen results bar displaying the results for at least two previously played games at the plurality of game tables, and allow a player at each one of the electronic handheld devices to switch between the plurality of the game table's videos in response to touching said touch screen results bar. In this way, a player can be sitting across the casino and monitoring the live table games. The table games can be any type of table games. Still further, the player can select which table they want to see the video of according to the results bar (e.g. 580, 590). For example, there may be a top results bar 580 that shows the past results of the last thirty to eighty games (this is by way of example only and not to be taken in a limiting sense). The top results bar 580 shows the past results for the table which corresponds to the video being shown on the electronic handheld device. There may be a larger number of past results (i.e. a larger results bar 590) for the table which corresponds to the video currently being shown on the electronic handheld device. The results bars below (590) may be abbreviated results bars which show, for example the last twenty games played at that table. In the example shown in FIG. 4D there are three other games results bars (590). The smaller results bars 590 each correspond to tables for which the video is not currently being shown on the electronic handheld device. The player may touch anyone of the results bars (e.g. the three results bars 580 shown in FIG. 4D) to select the video that corresponds to that table. Upon touching a results bar it becomes a selected results bar and the remaining touch screen results bars become unselected touch screen results bars. When the player selects that results bar (by touching it) it may become the larger results bar (590) showing a greater number of results and the video shows the table selected. If the player has selected a different results bar than the one currently selected (and for which the video is currently being shown) that selected results bar and the corresponding table becomes the video being displayed and the table which was being displayed drops down to the smaller results bars for which video is not currently being displayed and is not currently selected.

According to one embodiment, the live casino table game being played is a baccarat game. Each of the electronic handheld devices may be further configured to provide a screen showing game number (see, for example FIG. 4C, display 416 showing game number) and respective amounts bet on the banker pair, the player pair or the tie, the results bar showing a frequency of bank hand wins, player hand wins and ties in past games, and a sequence of the bank hand wins, the player hand wins and the ties in past games.

There may be any number of results bars shown, each of which correspond to a single gaming table. In this way, a player may be sitting at a slot machine (by way of example) and monitoring multiple table games without getting up from their seat. They may wait until the game shows historical data that they like (on the results bar) to decide to get up and play at the table. This increases revenue to the gaming establishment as players can be gambling and monitoring the tables. Also, certain players who may be intimidated can watch the table play and learn the process. This can add to the excitement of the player, as they can monitor multiple tables and easily switch between tables. Finally, it gives the player a feeling of an advantage being easily able to compare the multiple tables and select the table they feel has the greatest chances of delivering a win.

While particular embodiments of the present invention have been shown and described, it will be obvious to those skilled in the art that changes and modifications can be made without departing from this invention in its broader aspects. Therefore, the appended claims are to encompass within their scope all such changes and modifications as fall within the true spirit and scope of this invention.

The invention is claimed as follows:

1. A gaming terminal comprising:
a display device;
a processor; and
a memory device which stores a plurality of instructions, which when executed by the processor, cause the processor to:
cause the display device to display:
a first game taking place at a first game table located remote from the gaming terminal, and
simultaneously with the display of the first game, a player wagering area including a first results bar which displays historical data associated with at least two previously played games that occurred at a second game table located remote from the gaming terminal, and
separate from any placement of a bet on the first game taking place at the first game table and responsive to receipt of a selection of the displayed first results bar, cause the display device to switch to displaying a second game taking place at the second game table.

2. The gaming terminal of claim 1, wherein at least one of the display of the first game taking place at the first game table comprises a display of a video of the first game taking place at the first game table and the display of the second game taking place at the second game table comprises a display of a video of the second game taking place at the second game table.

3. The gaming terminal of claim 1, wherein the displayed player wagering area further comprises a bet button, wherein a bet is placed on the first game taking place at the first game table responsive to a selection of the bet button.

4. The gaming terminal of claim 1, wherein the displayed player wagering area further comprises a second results bar which displays historical data associated with at least two previously played games that occurred at a third game table located remote from the gaming terminal.

5. The gaming terminal of claim 4, wherein the displayed player wagering area further comprises a third results bar which displays historical data associated with at least two previously played games that occurred at the first game table.

6. The gaming terminal of claim 5, wherein the third results bar displays historical data associated with a greater quantity of previously played games that occurred at the first game table than a quantity of previously played games that occurred at the second game table and a quantity of previously played games that occurred at the third game table.

7. The gaming terminal of claim 1, wherein at least one of the first game and the second game is selected from the group consisting of: a baccarat game, a dice game, a roulette game, and a table game associated with game cards.

8. The gaming terminal of claim 1, further comprising a housing, and an acceptor supported by the housing, wherein when executed by the processor, the plurality of instructions cause the processor to: responsive to a physical item being received via the acceptor, establish a credit balance based, at least in part, on a monetary value associated with the received physical item, and responsive to a cashout input being received, cause an initiation of any payout associated with the credit balance.

9. A gaming terminal comprising:
a display device;
a processor; and
a memory device which stores a plurality of instructions, which when executed by the processor, cause the processor to:

cause the display device to display:

a first game taking place at a first game table located remote from the gaming terminal, and simultaneously with the display of the first game, a player wagering area including:

a first results bar which displays historical data associated with a first quantity of at least two previously played games that occurred at the first game table, a second results bar which displays historical data associated with a second quantity of at least two previously played games that occurred at a second game table located remote from the gaming terminal, separate from any placement of any bet and responsive to receipt of a selection of the displayed first results bar:

modify the first quantity of previously played games that occurred at the first game table, and cause the display device to display the modified first quantity of previously played games that occurred at the first game table, and separate from any placement of any bet and responsive to receipt of a selection of the displayed second results bar, cause the display device to switch to displaying a second game taking place at the second game table.

10. The gaming terminal of claim 9, wherein at least one of the display of the first game taking place at the first game table comprises a display of a video of the first game taking place at the first game table and the display of the second game taking place at the second game table comprises a display of a video of the second game taking place at the second game table.

11. The gaming terminal of claim 9, wherein the displayed player wagering area further comprises a third results bar which displays historical data associated with a third quantity of at least two previously played games that occurred at a third game table located remote from the gaming terminal.

12. The gaming terminal of claim 9, wherein at least one of the first game and the second game is selected from the group consisting of: a baccarat game, a dice game, a roulette game, and a table game associated with game cards.

13. A gaming system server comprising:

a processor; and a memory device which stores a plurality of instructions, which when executed by the processor, cause the processor to:

communicate data to a gaming terminal which results in a display device of the gaming terminal displaying:

a first game taking place at a first game table located remote from the gaming terminal, and simultaneously with the display of the first game, a player wagering area including a first results bar which displays historical data associated with at least two previously played games that occurred at a second game table located remote from the gaming terminal, and separate from any placement of a bet on the first game taking place at the first game table and responsive to receipt of data associated with a selection of the displayed first results bar, communicate data to the gaming terminal which results in the display device of the gaming terminal switching to display a second game taking place at the second game table.

14. The gaming system server of claim 13, wherein at least one of the display of the first game taking place at the first game table comprises a display of a video of the first game taking place at the first game table and the display of the second game taking place at the second game table comprises a display of a video of the second game taking place at the second game table.

15. The gaming system server of claim 13, wherein the displayed player wagering area further comprises a bet button, wherein a bet is placed on the first game taking place at the first game table responsive to a selection of the bet button.

16. The gaming system server of claim 13, wherein the displayed player wagering area further comprises a second results bar which displays historical data associated with at least two previously played games that occurred at a third game table located remote from the gaming terminal.

17. The gaming system server of claim 16, wherein the displayed player wagering area further comprises a third results bar which displays historical data associated with at least two previously played games that occurred at the first game table.

18. The gaming system server of claim 17, wherein the third results bar displays historical data associated with a greater quantity of previously played games that occurred at the first game table than a quantity of previously played games that occurred at the second game table and a quantity of previously played games that occurred at the third game table.

19. The gaming system server of claim 13, wherein at least one of the first game and the second game is selected from the group consisting of: a baccarat game, a dice game, a roulette game, and a table game associated with game cards.

20. The gaming system server of claim 13, wherein the data is wirelessly communicated to the gaming terminal.

* * * * *